US007854347B2

(12) United States Patent
Wang

(10) Patent No.: US 7,854,347 B2
(45) Date of Patent: Dec. 21, 2010

(54) MANUAL GAS INFLATOR

(76) Inventor: Hudson Wang, Factory No. 2, Industrial District, Houxi Xincun Jimei, Xiamen 361024 (CN)

( * ) Notice: Subject to any disclaimer, the term of this patent is extended or adjusted under 35 U.S.C. 154(b) by 1058 days.

(21) Appl. No.: 11/421,997

(22) Filed: Jun. 2, 2006

(65) Prior Publication Data

US 2008/0000926 A1 Jan. 3, 2008

(51) Int. Cl.
*B67D 7/00* (2010.01)
*B65B 1/04* (2006.01)
*B63C 9/15* (2006.01)

(52) U.S. Cl. ..... 222/5; 222/23; 222/51; 222/3; 141/329; 141/330; 441/41; 441/94

(58) Field of Classification Search ..... 222/3, 222/5, 52, 53, 54, 61, 23; 141/19, 329, 330; 441/9, 40, 41, 90, 92, 93, 94, 95, 96, 97
See application file for complete search history.

(56) References Cited

U.S. PATENT DOCUMENTS 1,230,290 A * 6/1917 Geiger ..... 441/93
2,722,342 A * 11/1955 Fox ..... 222/5
2,894,658 A * 7/1959 Spidy ..... 222/5
3,630,413 A * 12/1971 Beckes et al. ..... 222/5
3,648,898 A * 3/1972 Day ..... 222/5
4,475,664 A * 10/1984 Mackal ..... 222/5
4,498,605 A * 2/1985 Mackal et al. ..... 222/5
4,500,014 A * 2/1985 Zimmerly ..... 222/5
4,524,885 A * 6/1985 Zimmerly ..... 222/5
5,333,756 A 8/1994 Glasa
5,370,567 A 12/1994 Glasa
5,509,576 A 4/1996 Weinheimer et al.
5,562,233 A * 10/1996 Glasa ..... 222/5
5,590,696 A * 1/1997 Phillips et al. ..... 141/47
5,601,124 A 2/1997 Weinheimer et al.
5,643,030 A 7/1997 Brown
5,921,835 A 7/1999 Gordon et al.
6,254,447 B1 * 7/2001 Niemann ..... 441/101
6,422,420 B1 7/2002 Brown
6,589,087 B2 7/2003 Mackal et al.
6,705,488 B2 3/2004 Mackal et al.
7,299,816 B2 * 11/2007 Rouleau et al. ..... 137/68.3

* cited by examiner

*Primary Examiner*—Kevin P Shaver
*Assistant Examiner*—Stephanie E Williams
(74) *Attorney, Agent, or Firm*—Daniel S. Polley, P.A.

(57) ABSTRACT

A manual gas inflator incorporating a cylinder status indication mechanism that is independent from the cylinder piercer. Prior to detonation, an indicator post abuts a sensor protrusion which positions a green surface of the indicator within the inflator window to indicate that the attached cartridge is ready for use. The jerking of a lanyard assembly causes the piercer to break the cylinder seal to allow gas to escape out of the cylinder and into a manifold secured to the inflator and also causes the indicator post to break the sensor protrusion from the cylinder. As the protrusion is broken, a second red surface of the indicator is viewable through the inflator window to indicate that the cylinder has been used and unavailable for inflation purposes.

24 Claims, 10 Drawing Sheets

MANUAL GAS INFLATOR

BACKGROUND OF THE INVENTION

1. Field of the Invention

The present invention relates generally to inflators and particularly to a manual gas inflator.

2. Background of the Art

U.S. Coast Guard regulations require that gas inflators provide a status indicator for the gas cylinder attached to the inflator. The status indicator informs the user of the cylinder status prior to needing the inflator to inflate an inflatable item such as, but not limited to, life vests, rafts, etc. Typically two states are provided for the status, either operable or spent. Typically a green color indicates that the cylinder is full and operable, while a red color indicates that the cylinder has been spent. Prior inflator designs use the attachment of the cylinder itself to position the status indicator. The present invention is directed to a manual gas inflator that positions the status indicator independent of the cylinder.

SUMMARY OF THE INVENTION

The present invention provides a manual gas inflator incorporating a cartridge status indication mechanism that is independent from the cartridge piercing pin. In a preferred embodiment the inflator comprises a body portion, an activating assembly, an indicator, a pierce pin, a push or positioner assembly, a gas (such as, but not limited to carbon dioxide) status sensor or blocking member and associated parts and components.

During assembly the push cover is connected to the indicator and the pierce pin is connected to the indicator. The associated springs, washer and o-ring are also properly positioned. These connected components are internally disposed within the inflator body. The arming assembly, which comprises the carbon dioxide ("CO2") sensor or blocking member secured to a gas cartridge/cylinder through a nut (with or without a screw) is secured to the inflator body by the mating of threads on the cylinder with internal threads of an inflator body passageway.

When properly connected a breaking post of the indicator abuts an internal protrusion of the gas sensor or blocking sensor which positions or aligns a first surface area of the indicator (which can be green in color though not considered limited to the color green) with a window defined by the inflator body so that the first surface area is viewable to indicate that the attached cartridge is full (operable) and ready for use.

When it is desired to inflate the inflatable item associated with the manifold, the user jerks or pulls a lanyard handle or tab which causes the lanyard to move a contact arm of the lanyard assembly to contact the push cover. The force of this contact causes the indicator breaking post to move forward and break or snap the protrusion of the gas sensor and at the same time also moves a pierce pin forward to pierce a diaphragm seal on the cylinder and allow the gas to escape from the cylinder and into the manifold and ultimately to the item associated with the manifold. A second surface area of the indicator (which can be red in color though not considered limited to the color red) is now aligned with and viewable through the inflator body window to indicate that the cartridge has been used (spent, detonated, etc.) and is no longer available for inflation purposes.

The arming assembly can be removed from its secured attachment to the inflator and a new arming or rearming assembly can be similarly secured to the inflator. Once rearmed, the first color area will again be viewable in the inflator body window indicating that the inflator is ready for use.

BRIEF DESCRIPTION OF THE DRAWINGS

FIG. 2 is an exploded view of the manual gas inflator of FIG. 1 and a manifold to which the inflator can be secured to;

DETAILED DESCRIPTION OF THE PREFERRED EMBODIMENT

Figure 1:
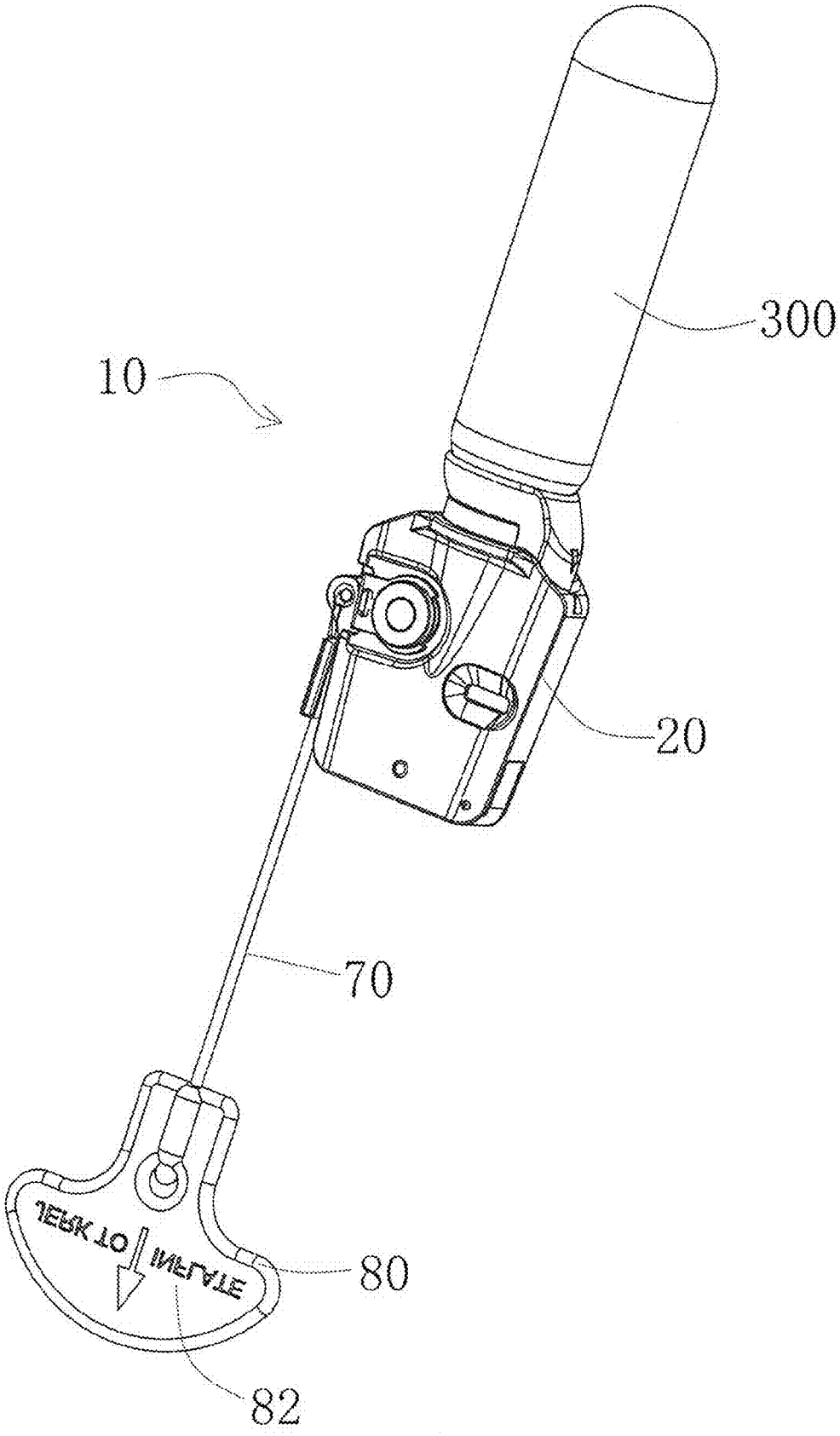
FIG. 1 is a perspective view of the manual gas inflator in accordance with the present invention.

As seen in the drawings, a manual gas inflator in accordance with the present invention is shown and generally designated as inflator 10. Inflator 10 generally consists of a body 20, activating assembly 60, indicator 160, pierce pin 190, push or positioner assembly 130, carbon dioxide ("CO2") status sensor or blocking sensor 100 and associated parts and components that will be discussed in further detail below.

Figure 2:
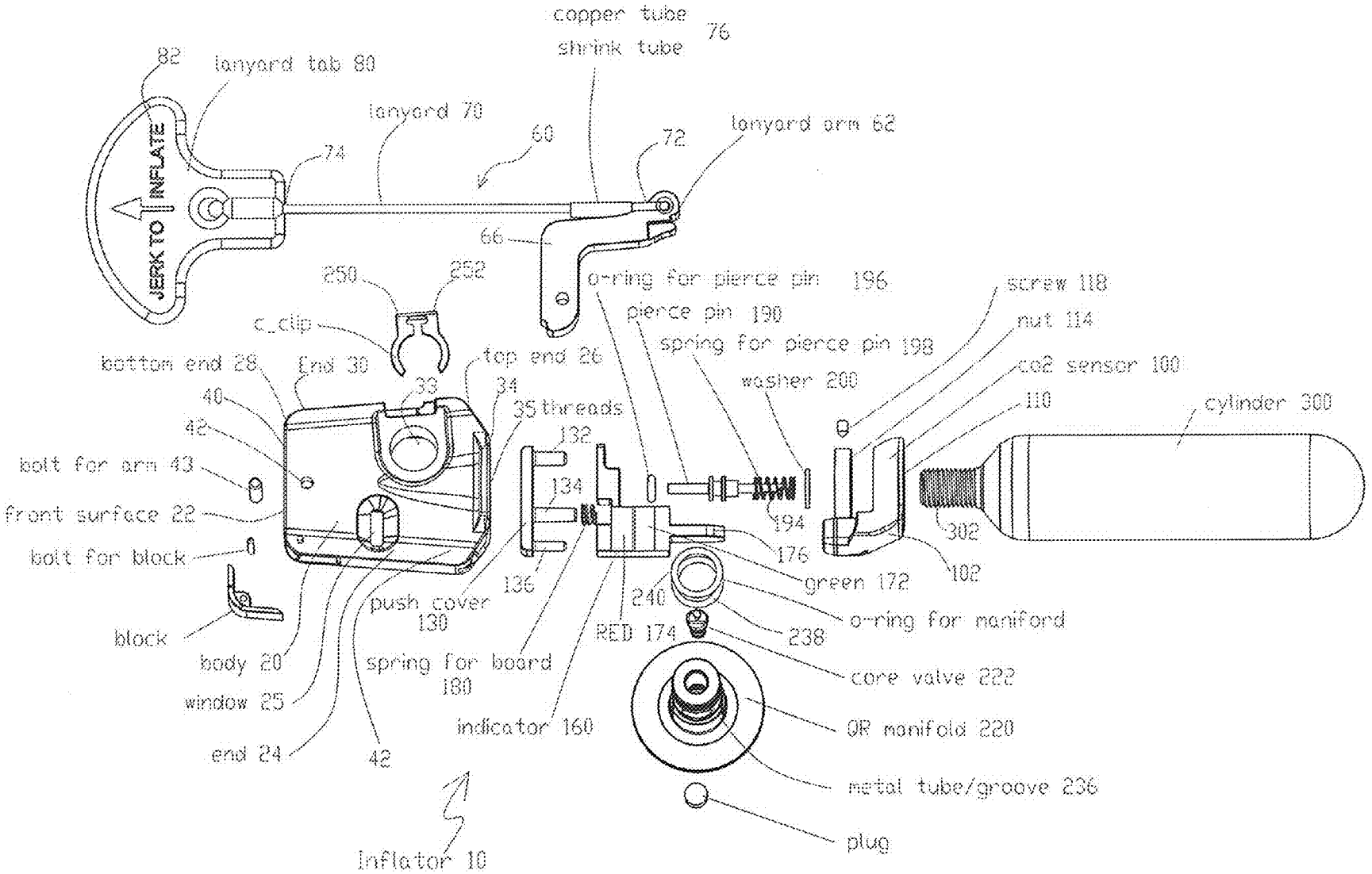
Figure 8:
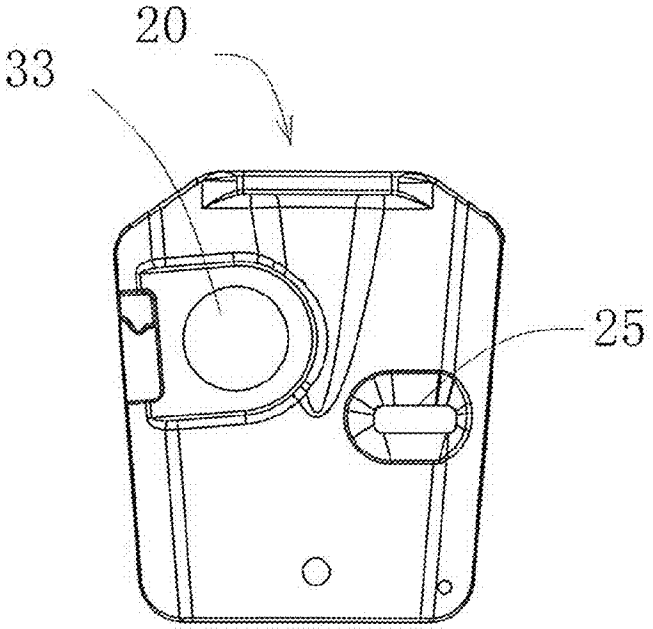
FIG. 8 is a front view of the inflator body of FIG. 6.

Inflator 10 can be secured to a manifold, such as manifold 220, which can include a "C" clip 250 (See FIG. 2). Manifold 220 will be generally discussed in connection with the operation of inflator 10 and is discussed in more detail in application Ser. No. 60/60/702,923, filed Jul. 27, 2005, which is incorporated by reference in its entirety.

Figure 14:
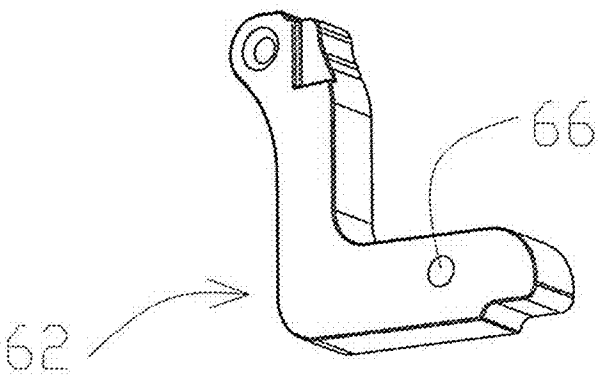
FIG. 14 is a perspective view of the lanyard arm for the lanyard assembly of FIG. 13.

As best seen in FIGS. 6 through 9, inflator body 20 includes a front surface 22, back surface 23, first side end 24, top end 26, bottom end 28 and second side end 30. Front surface 22 includes a window or opening 25 for determining the status of an attached gas cartridge or cylinder, such as, but not limited to, CO2 cylinder or cartridge 300, which will be discussed in further detail below. Front surface 22 is also provided with opening 42 for receiving a contact arm bolt, pin or similar structure (collectively "bolt") 43 for securing contact arm 62 of activating assembly 60 to body 20. Contact arm 62 includes an opening 64 (See FIG. 14). When securing contact arm 62 to body 20, contact arm opening 64 can be aligned with opening 42 and bolt 43 is inserted within both openings and maintained by conventional mechanisms, such as, but not limited to a tight/friction fit, screwed in to body 20, etc. An opening 32 in front surface 22 represents a first end of a manifold receiving passageway 33. The second end of passageway 33 is represented by an opening 35 in back surface 23 of body 20 and is provided with a unique configuration, which mates with a unique configuration of a manifold base, such that there is provided only one proper way for inserting the manifold within passageway 33.

Figure 7:
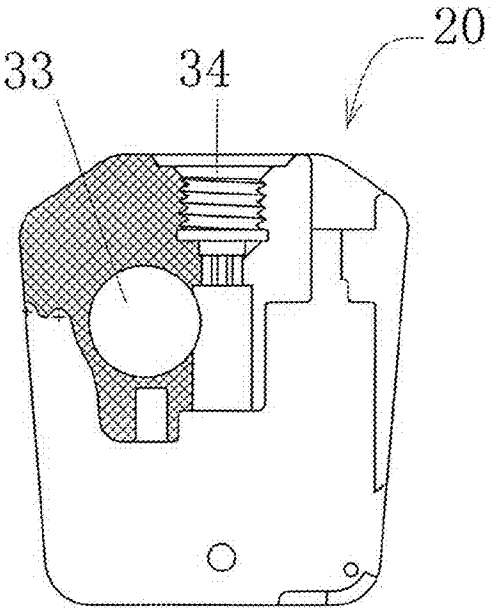
FIG. 7 is a sectional view of the inflator body of FIG. 6.
Figure 3:
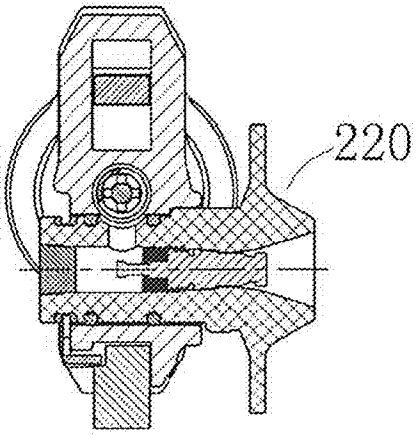
FIG. 3 is a first sectional view of the manual gas inflator of FIG. 1.
Figure 4:
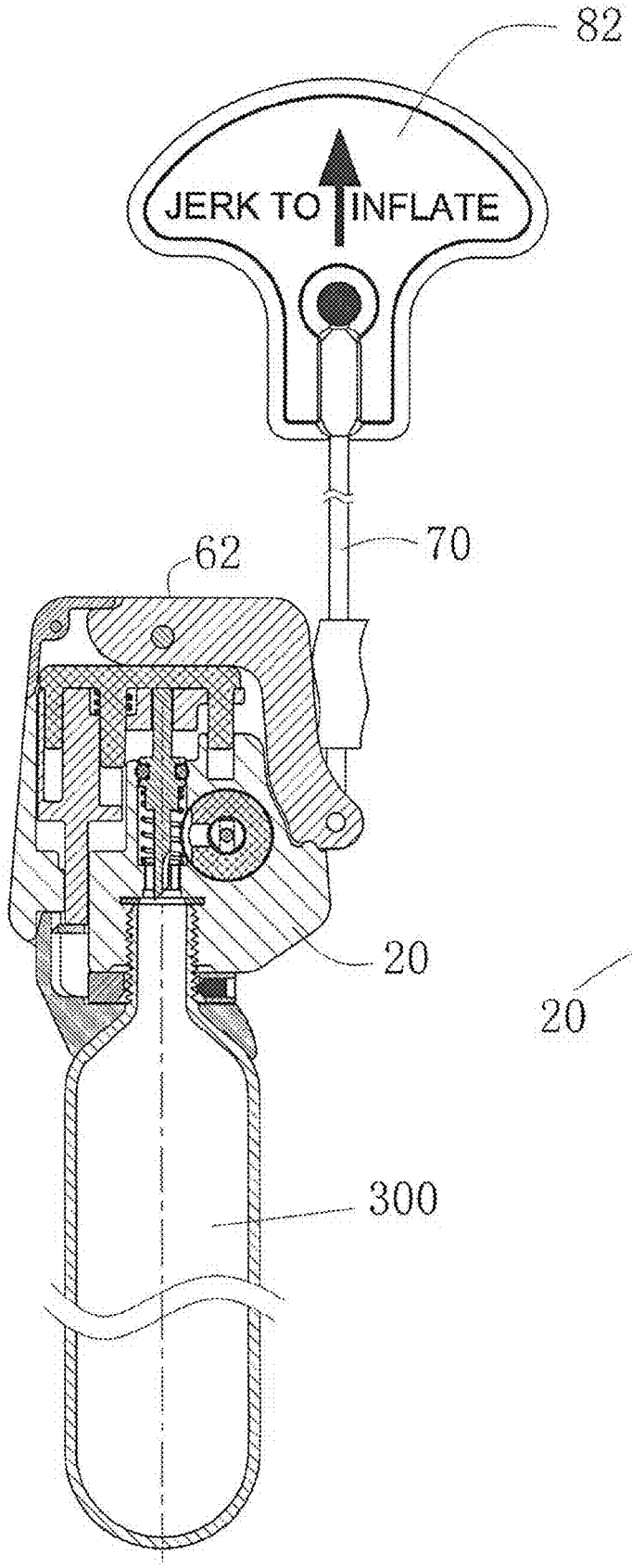
FIG. 4 is a second sectional view of the manual gas inflator of FIG. 1 showing the inflator prior to use.
Figure 6:
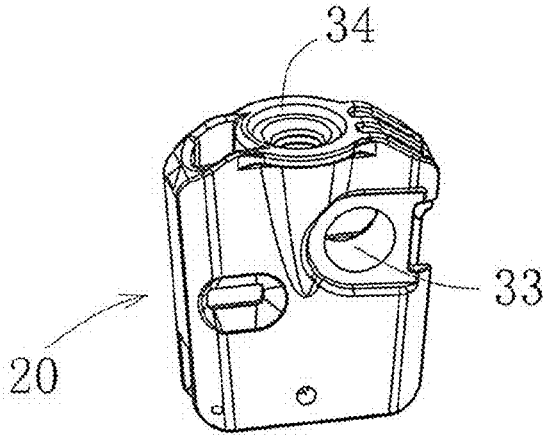
FIG. 6 is a perspective view of the inflator body for the manual gas inflator of FIG. 1.
Figure 5:
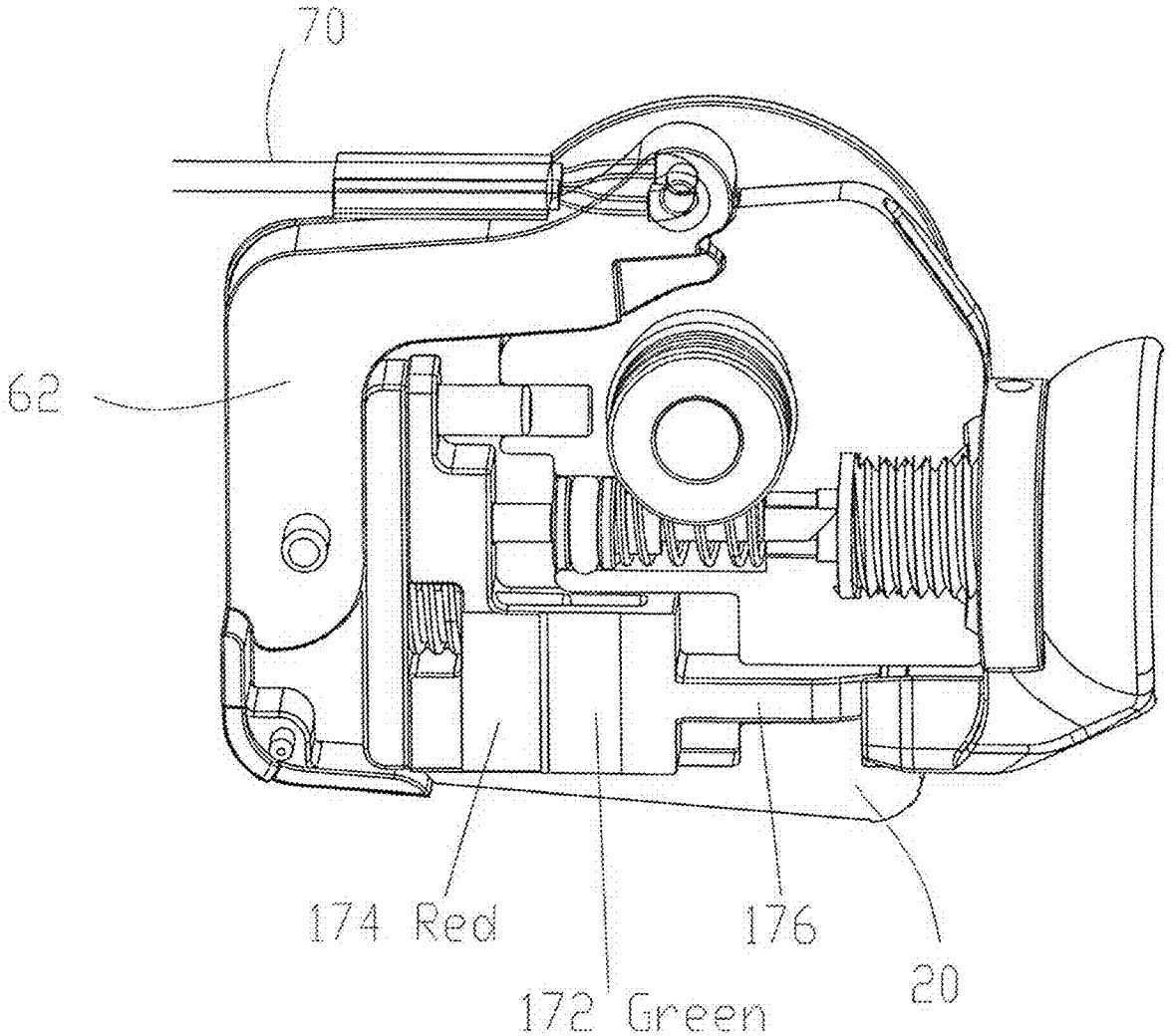
FIG. 5 is a third sectional view of the manual gas inflator of FIG. 1 again showing the inflator prior to use.

A portion of body 20 at second side end 30 can be cutout or hollow for receipt of a portion of contact arm 62. Body 20 can be cutout hollow at bottom end 28 for receipt of the other portion of contact arm 62 and also provides internal access for positioning the internal components of inflator 10 such as indicator 160, pierce pin 190, push assembly 130 and their associated components or parts. FIGS. 4, 5 and 7 best illustrate the internal area of body 20 and show where solid portion exist to create various passageways, openings, etc. A removable block 40 can be secured to body 20 by block pin 41 (similar to how bolt 43 secures lanyard arm 62). With block 40 removed, a wider area is provided for inserting the internal components. However, it is also within the scope of the invention, that block 40 is not provided or removable, and that body 20 can be solid at this area.

Top end 26 includes a passageway 34 having internal threads 35 for mating with threads 302 of CO2 cartridge 300. Passageway 34 is in communication with passageway 33. Top end 26 also includes aperture 42 for receipt of a lower portion 103 of body 102 or CO2/gas sensor or blocking member 100.

Figure 10:
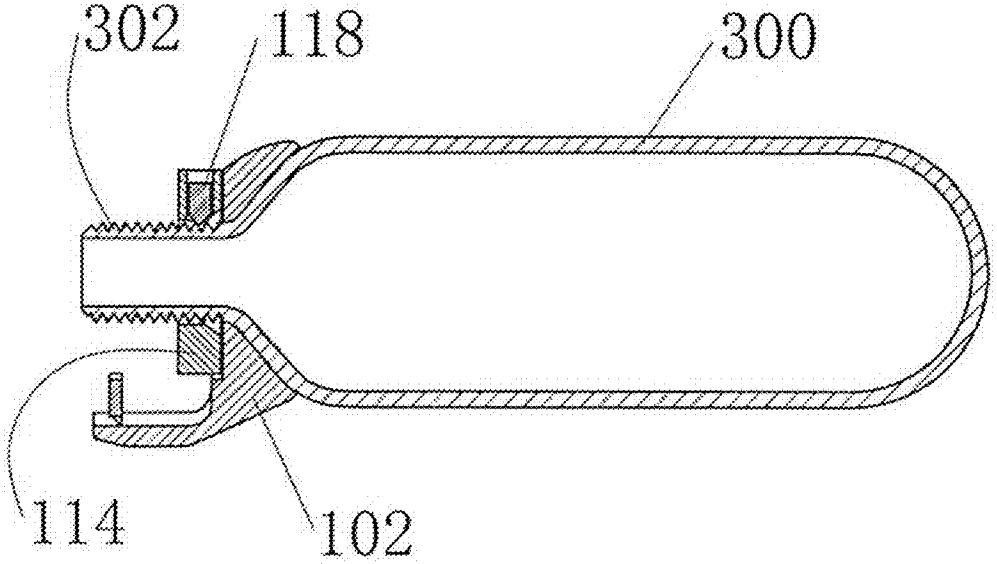
FIG. 10 is a sectional view of the arming or rearming assembly in accordance with the manual gas inflator of FIG. 1.
Figure 9:
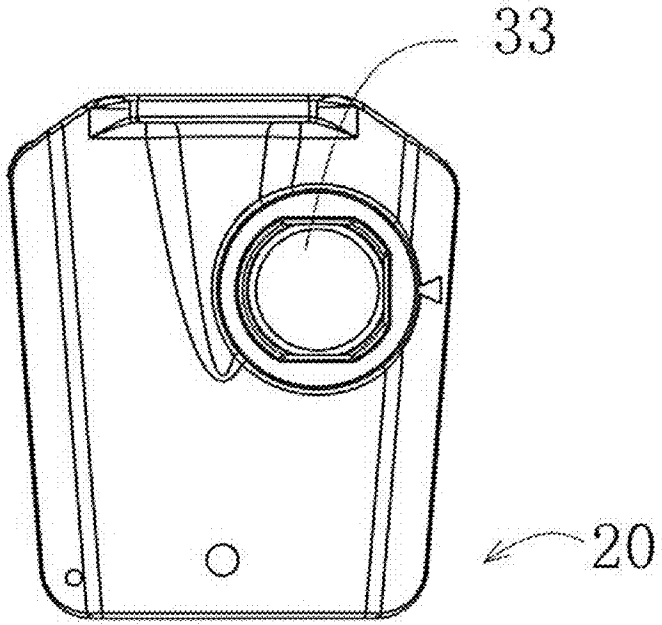
FIG. 9 is a back view of the inflator body of FIG. 6.
Figure 12:
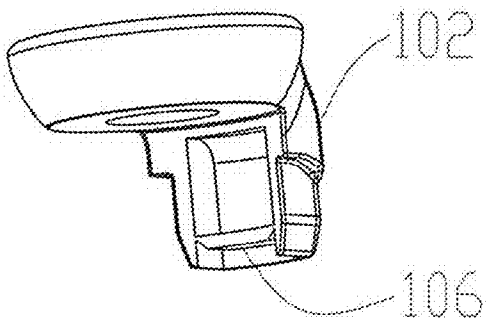
FIG. 12 is a second perspective view for the carbon dioxide ("CO2") sensor or blocking member for the manual gas inflator of FIG. 1 and rearming assembly of FIG. 10.
Figure 11:
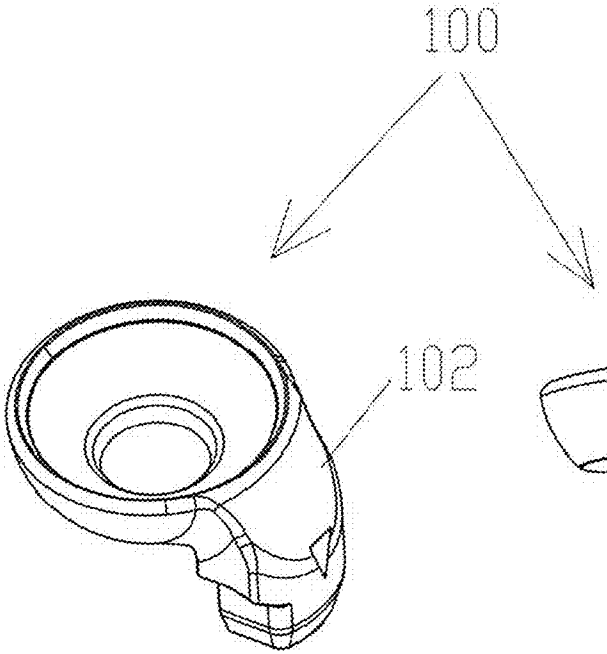
FIG. 11 is a first perspective view for the carbon dioxide ("CO2") sensor or blocking sensor for the manual gas inflator of FIG. 1 and rearming assembly of FIG. 10.
Figure 20:
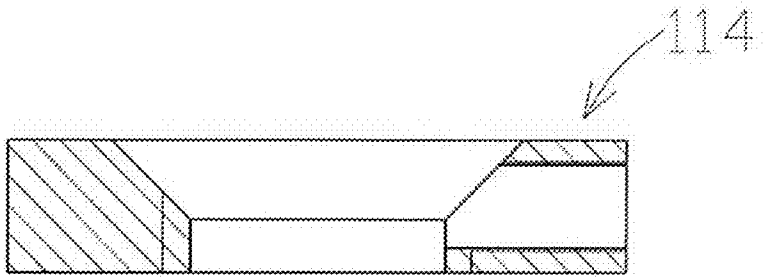
FIG. 20 is a sectional view of the nut of the CO2 sensor assembly for the manual gas inflator of FIG. 1 and reaming assembly of FIG. 10.

As best seen in FIGS. 11 and 12, sensor blocking member body 102 includes an internal hollow area 103 having an internal protrusion 106 extending into hollow area 103. The purpose of protrusion 106 will be discussed in detail below in conjunction with indicator 160. Sensor Blocking member body 102 also includes an opening 110 for receipt of threaded portion 302 of cartridge 300. A nut 114 (See FIG. 20) and screw 118 can also be provided. Nut 114 is used to secure sensor blocking member body 102 to cylinder 300, while allow sensor or blocking member body 102 to freely rotate or spin in place around cylinder 300. When inserted within nut 114, as described below, screw 118 prevents cylinder 300 from moving or rotating with respect to nut 114. Secured sensor 100 to cartridge 300 by nut 114, with or without screw 118, can be defined as an arming assembly and as a rearming assembly when replacing a spent or detonated cylinder 300 on inflator 10 (See FIG. 10).

Figure 17:
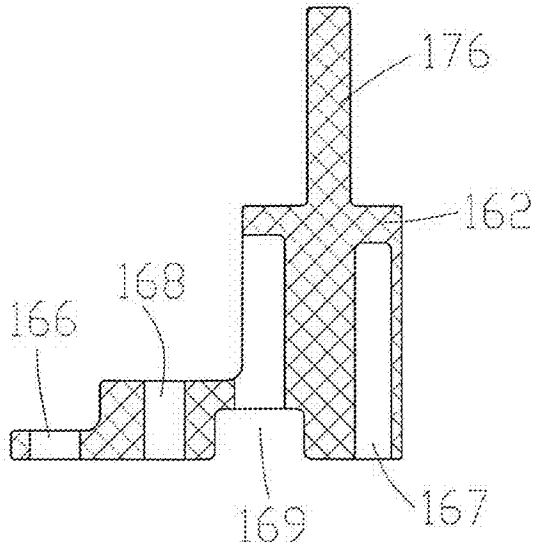
FIG. 17 is a sectional view of the indicator of FIG. 16.
Figure 16:
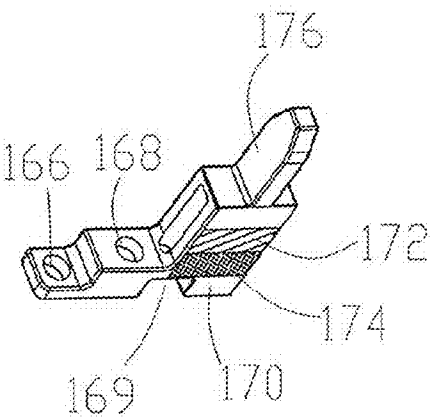
FIG. 16 is a perspective view of the indicator for the manual gas inflator of FIG. 1.

As seen in FIGS. 16 and 17, body 162 of indicator 160 can include a front surface 170, a breaking post 176, a first push post receiving aperture 166, a second push post receiving aperture 167 and a pierce pin receiving aperture 168. Indicator body 162 also includes a cutout 169 for receipt a middle push post 134 of push assembly 130 and board spring 180. Front surface 170 includes a first color area 172 (preferably "green") and a second color area 174 (preferably "red"). Second color area 174 represents that CO2 cartridge 300 secured to body 20 has been used, while second color area 172 represents that CO2 cartridge is ready for use. Thus, color areas 172 and 174 provide a "status" indicator for the CO2 cartridge secured to body 20.

Figure 18:
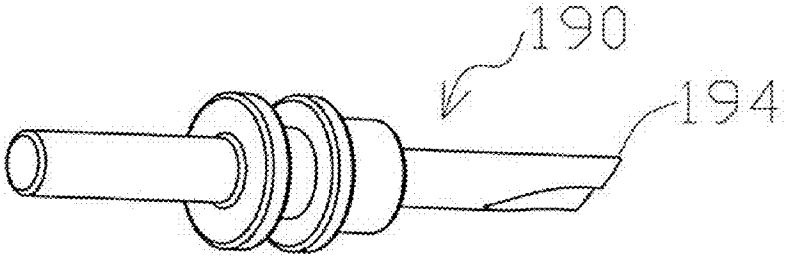
FIG. 18 is a perspective view of the piercing assembly for the manual gas inflator of FIG. 1.
Figure 19:
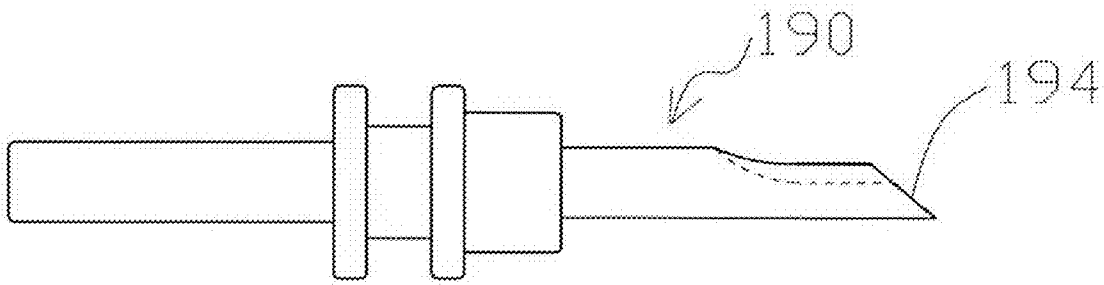
FIG. 19 is a side view of the piercing assembly of FIG. 18.

As seen in FIGS. 18 and 19, pierce pin 190 include a first end 192 which is received within pierce pin aperture 168 of indicator 160 and an opposite sharp or pointed end 194 which serves to pierce the cartridge seal (i.e. diaphragm) of CO2 cartridge 300 when it is desired to inflate the article to which manifold 220 is associated with (i.e. life raft, life vest, life jacket, tube, etc.). A spring 198 and washer 200 are also provided at pointed end 194. Pierce pin spring 198 helps to keep pierce pin 190 flush with the bottom of the threads. Washer 200 aids in attaching CO2 cylinder 300 during screwing in. The operator can feel the resistance telling him or her that CO2 cylinder 300 is nearly torqued sufficiently. Washer 200 also helps in providing for a good seal during the CO2 flow out of cylinder 300 once pierce pin penetrates or breaks the cylinder seal. Pierce pin 190 also comprises a lower half rod, which helps to keep pierce pin 190 and indicator 160 function separately. O-ring 196 can also be provided preferably in the middle of pierce pin 190 and acts as seal to keep the CO2 flow where it needs to go, namely, thru manifold 220 and ultimately within the inflatable chamber associated with manifold 220.

To secure the arming/reaming assembly to inflator 10, a portion of sensor body 102 is positioned within opening 42 in body 20 and threaded end 302 of cylinder 300 is secured to passageway 34 mating the threads of end 302 with the internal threads in passageway 34. As sensor body 102 freely rotates in place with respect to cylinder 300, cylinder 300 is permitted to be turn such that threaded end 302 rides the internal threads of passageway 34. Once threaded end has properly mated with the internal threads of passageway 34, the sealed threaded end (such as, but not limited to, through a diaphragm seal or other sealing mechanism, etc.) is positioned proximate to pierced end 194 of pierce pin 190 and protrusion 106 contacts breaking post 176 of indicator 160 which allows first color area 172 to be viewable through window 25 to indicate that cartridge or cylinder 300 is "OK" for use.

Figure 15:
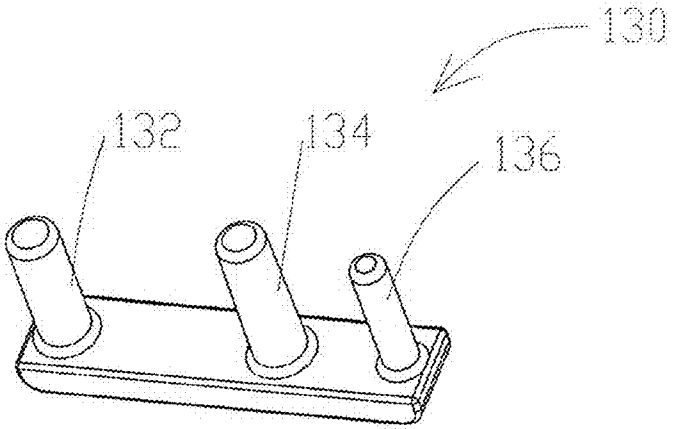
FIG. 15 is a perspective view of the push cover/positioner for the manual gas inflator of FIG. 1.

As best seen in FIG. 15, push assembly 130 includes a first post 132 which is received within indicator aperture 166 and a second post 136 which is received within indicator aperture 167. As mentioned above, push assembly 130 also includes a middle post 134 which is received within indicator cutout 169 along with spring 180. Indicator 160 can also be provided with an internal passageway 177 which is in communication with indicator cutout 169. Prior to detonation of cylinder 300 through inflator 10, a portion of middle post 134 can be received within indicator internal passageway 177 with spring 180 in a compressed configuration.

Figure 13:
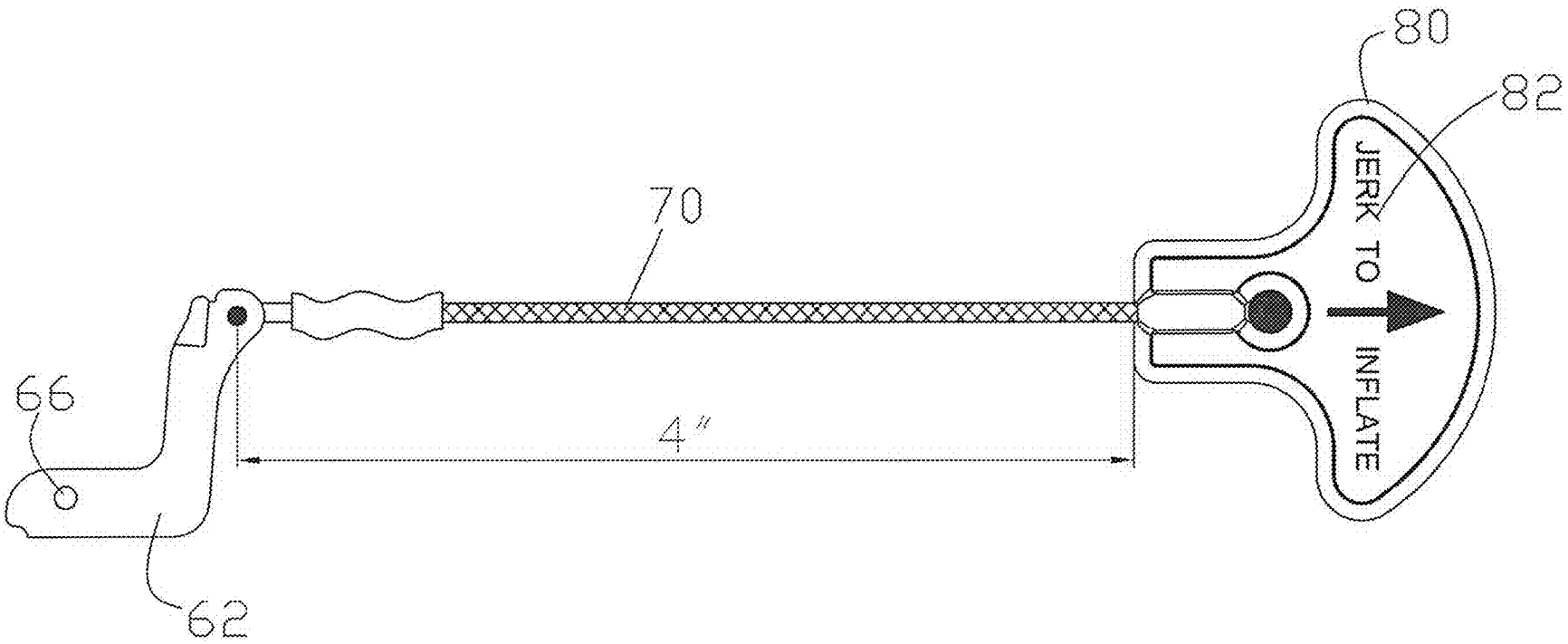
FIG. 13 is a side view of the activating assembly for the manual gas inflator of FIG. 1.

As best seen in FIG. 13, in addition to contact arm 62, activating assembly 60 can comprise a lanyard, rope, strap, line, cord, etc. (collectively referred to as lanyard 70) having a copper or other metal tube/shrink tube 76 and a lanyard tab or handle 80. Lanyard 70 can have a first end 72 which is connected to contact arm 62 and a second end 74 which is connected to lanyard tab 80. The copper or other metal tube acts as a crimp to hold the lanyard together for strength. The shrink tube helps to keep the lanyard tucked in and help to prevent it from rubbing against a chamber or bladder of air. Lanyard tab 80 can include indicia 82 on either one or both surfaces. In one embodiment, indicia 82 can be operating instructions, or a message such as, but not limited to, "JERK TO INFLATE", etc.

To assemble manual inflator 10, push cover 130 is connected to indicator 160 and pierce pin 190 is connected to in indicator 160. The associated springs, washer and o-ring are also properly positioned. These connected components are internally disposed within body 20. CO2 sensor or blocking sensor 100 with cartridge 300, screw 118 and nut 114 connected thereto is attached to body 20 through the mating of threads 302 with internal threads 35 of body passageway 34. As mentioned above, when properly connected breaking post 176 abuts internal protrusion 106 of sensor or blocking sensor 100 which positions or aligns green surface area 174 with body window 25 so that it is viewable to indicate that cartridge 300 is full (operable) and ready for use. The abutting position of post 176 with protrusion 106 also positions piercing end 194 at the sealed end of cartridge or abutting the seal, which can be a diaphragm or other type of device used to seal cartridge 300 prior to use. Activating assembly 60 is secured to body 20 through bolt 43 and contact arm 62. If block 40 is provided, then it can be attached to body 20 through its associated bolt or pin. Block 40 can also help to position contact arm 62 with respect to body 20.

The assembled inflator 10 is positioned on manifold 220 such that opening 230 of manifold 220 is communication with body passageway 34 and that body passageway 34 is positioned between manifold o-rings 238 and 240 to provide a sealed communication between opening 230 and passageway 34. The shape of the post 226 at its base 228 can be configured to correspond with opening/second end 35 of body passageway 33 such that preferably there is only one way to match the shape of base 228 with opening 35 of passageway 33. This helps to ensure that manifold 220 is properly positioned with respect to inflator 10, namely, that body passageway 34 is positioned between o-rings 238 and 240 and aligned with opening 230. Once inflator 10 is properly attached to manifold 220, clip 250 can be disposed within groove 236 (which can be provided with a metal tube or insert) to act as a stop member and help prevent inflator 10 from being accidentally disconnected from manifold 220.

When it is desired to inflate the inflatable item associated with manifold 220, the use jerks or pulls lanyard handle 80 which causes lanyard arm 62 to rotate around bolt 43 such that end 63 contact push cover 130. The force of this contact causes breaking post 176 to move forward and break or snap protrusion 106 of sensor or blocking sensor 100 and at the same time also moves pierce pin 190 forward to pierce the diaphragm seal and allow the gas to escape from cylinder or cartridge 300. The escaped gas enters body passageway 34 and into manifold opening 230 and ultimately inflates the intended item associated with manifold 220. Through the expansion of spring 180 red surface 172 is now aligned with and viewable through body window 25 to indicate that cartridge 300 has been used and is no longer available for inflation purposes.

CO2 sensor or blocking sensor 100, nut 114, screw 118 and spent cartridge 300 can be removed from their secured attachment to body 20 by unmating threads 302 with threads 35 of body passageway 34 to release the connection. A new CO2 sensor or blocking member 100 having an unbroken internal protrusion 106, along with attached new attached nut 114, a new screw 118 and new sealed cartridge 300 (collectively referred to as a "reaming kit" or "rearming assembly") can then be secured to body 20 as described above. As protrusion 106 for new CO2 sensor or blocking member 100 is unbroken, indicator post 176 abuts protrusion 106 and indicator 160 is positioned such that "green" status surface 174 appears in window 25 to indicate that CO2 cartridge 300 is full and ready for use.

As described above CO2 sensor or blocking member 100 is separate from pierce pin 190. By pulling lanyard tab 80, lanyard arm 62 contacts push cover 130 to move pierce pin 190 and indicator arm 160 towards CO2 cylinder 300. While pierce pin 190 penetrates or breaks the seal for CO2 cylinder 300, at the same time indicator arm 160 breaks sensor blocking member clip or protrusion 106 inside the arm of sensor body 102. Once CO2 sensor clip 106 is broken, window 25 displays red surface 172 of indicator 160 to indicate that CO2 cylinder 300 is spent and needs replacement. Spring 180 disposed between push cover 130 and indicator 160 pushes indicator 160 up and maintains the position of indicator 160 so that window 25 displays red surface 172 once sensor clip or protrusion 106 is broken or when no rearming kit is secured to body 20. Since clip or protrusion 106 is broken, the indicator arm does not have anything pushing it down to align green surface 174 with window 25 and thus red surface 172 is shown in window 25 instead.

Prior to rearming, pierce pin 190 can be flush or substantially flush with the top of the inflator body opening 34. Securing a new rearming kit to body member 20 pushes pierce pin 190 (via clip 106 and indicator post 176) back to its internal position with respect to body 20 where it is ready for piercing the seal of new cartridge 300 when needed (i.e. normal rearming position). A good CO2 sensor or blocking member 100, will have an unbroken clip or protrusion 106 and thus will push indicator 160 down, such that green surface 174 is displayed in window 25, to indicate that inflator 10 is rearmed.

The construction of inflator 10 also permits a user, such as in an emergency situation, to screw in a conventional CO2 cartridge without a sensor 100. In this situation, red surface 172 (status indication) will be displayed in window 25 since there is no clip or protrusion 106 abutting indicator post 176. However, the wearer or user knows that the CO2 cartridge is good and inflator 10 can still be used. In these situations, the user again pulls lanyard tab 80 to move lanyard arm 62 to inflate a personal flotation device ("PFD") or other desired inflatable item similar to as described above.

Though the primary use of inflator 10 will be with a cartridge or cylinder 300 containing CO2, it is within the scope of the invention to store or house other gases within cartridge/cylinder 300 and inflator can be used for these gases as well similar to as described above for a cartridge/cylinder 300 storing CO2. It should also be recognized that certain of the components for inflator 10 described separately above can be combined as a one piece integral or monolithically formed component. As a non-limiting example, pierce pin 190 and indicator 160 can be provided as a one piece member.

The various o-rings are provided for sealing purposes at their several locations within body 20 to help prevent or reduce gas leakage to maximize the amount of gas from cylinder 300 that enters in the internal passageway of manifold 220.

While the invention has been described and disclosed in certain terms and has disclosed certain embodiments or modifications, person skilled in the art who have acquainted themselves with the invention, will appreciate that it is not necessarily limited by such terms, nor to the specific embodiments and modifications disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A manual gas inflator comprising:

a body having a front surface and a back surface, the front surface defining a window and having a body opening extending from said front surface to said back surface, said body having an internal passageway beginning at a top end and terminating at the body opening such that the internal passageway is in communication with the body opening;

an activation assembly movably secured to said body, said activation assembly having a contact arm, a lanyard and a handle, said lanyard secured at a first end to said contact arm and at a second end to said handle;

an indicator internally disposed within said body, said indicator having a front surface, said indicator front surface having a first color area and a second color area, said second color area being different in color from said first color area, said indicator having a post member, said first color area indicating a full gas cylinder is properly attached to said body and said second color area indicating that a detonated or empty gas cylinder is attached to said body;

a positioning assembly internally disposed within said body and physically contacting said indicator, said contact arm positioned within said body proximate to said positioning assembly;

a piercing assembly having a piercing end, said piercing assembly secured to said indicator; and a blocking member having a body with an extended arm, said arm defining an internal area and having a protrusion extending within the internal area; said blocking member adapted for attachment to the gas cylinder, the gas cylinder having a threaded end which is sealed prior to detonation;

wherein prior to detonation of an attached gas cylinder, said post member of said indicator contacts said protrusion of said blocking member such that said first color area of said indicator is viewable through the window of said body; wherein upon detonation of an attached gas cylinder said post member breaks said protrusion such that said second color area of said indicator is viewable through the window.

2. The manual gas inflator of claim wherein the opening at the back surface of said body is shaped such that a manifold to which the body is secured to can only be inserted one way into the opening to ensure that an opening in the manifold aligns with the internal passageway of said body when said body is secured to the manifold.

3. The manual gas inflator of claim 1 wherein said blocking member body defining a central opening; said inflator further comprising a nut defining a central opening, said nut central opening at least partially threaded; wherein to attach said blocking member to the gas cylinder the threaded end of the gas cylinder is inserted through the central opening of said blocking member body and mates with the threads of the nut central opening allowing the nut to ride up the gas cylinder threads to secure said blocking member to said gas cylinder with said blocking member permitted to rotate in place around said gas cylinder.

4. The manual gas inflator of claim 1 wherein the internal passageway of said body having internal threads at least proximate to the top end of said body; wherein when said nut is secured to the threaded end of said gas cylinder a portion of the cylinder threads extend our of said nut for mating with the internal threads of said internal passageway of said body to attach said the gas cylinder to said body.

5. The manual gas inflator of claim 3 wherein said nut having a side passageway extending from an outer end of said nut to the central opening of said nut; wherein said inflator further comprising a screw; wherein once said nut is properly secured and positioned with respect to the gas cylinder threads said screw is secured within said side passageway and contacts a portion of said gas cylinder threads to prevent said gas cylinder from substantially moving or rotating with respect to said nut.

6. The manual gas inflator of claim 5 wherein said screw is permanently secured within said side passageway.

7. The manual vas inflator of claim 1 wherein to detonate a gas cylinder secured to said body, said handle is pulled or jerk causing the contact arm to push said positioning assembly and said indicator forward which causes the post member to break the protrusion of said blocking member and the piercing end of said piercing assembly to break the seal at the threaded end of the secured gas cylinder causing gas to escape from the gas cylinder and enter into the internal passageway of said body for delivery into an internal passageway of a manifold that is secured to said body at said body opening.

8. The manual vas inflator of claim 7 wherein said indicator having a cutout and an internal passageway, said internal passageway of said indicator in communication with the cutout; wherein said positioning assembly having a first post member, wherein said manual gas inflator further comprising a spring, disposed on the first post member of said positioning assembly and within the indicator cutout; wherein prior to detonation of the secured gas cylinder said first post member is positioned within the cutout and indicator passageway and the protrusion abutting the post member of said indicator prevents the indicator from moving forward and causing the spring to be in a compressed state; wherein upon detonation of the secured gas cylinder the breaking of the protrusion allows the spring to expand to maintain the position of said indicator with respect to the body such that the second color area to be viewable through the window of said body.

9. The manual gas inflator of claim 1 wherein said first color area is "green" in color and the second color area is "red" in color.

10. A manual gas inflator comprising:

a body having a front surface and a back surface, the front surface defining a window and having a body opening extending from said front surface to said back surface, said body having an internal passageway beginning at a top end and terminating at the body opening such that the internal passageway is in communication with the body opening, said internal passageway of said body haying internal threads at least proximate to the top end of said body;

an activation assembly movably secured to said body, said activation assembly having a contact arm, a lanyard and a handle, said lanyard secured at a first end to said contact arm and at a second end to said handle;

an indicator internally disposed within said body, said indicator having a front surface, said indicator from surface having a first color area and a second color area, said second color area being different in color from said first color area, said indicator haying a post member, said first color area indicating a full gas cylinder is properly attached to said body and said second color area indicating that a detonated or empty gas cylinder is attached to said body;

a positioning assembly internally disposed within said body and physically contacting said indicator, said contact arm positioned within said body proximate to said positioning assembly;

a piercing assembly having a piercing end, said piercing assembly secured to said indicator;

a blocking member having a body with an extended arm, said arm defining an internal area and having a protrusion extending within the internal area, said blocking member body defining a central opening; said blocking member adapted for attachment to the gas cylinder, the gas cylinder having a threaded end which is sealed prior to detonation;

a nut defining a central opening, said nut central opening at least partially threaded;

wherein to attach said blocking member to the gas cylinder the threaded end of the gas cylinder is inserted through the central opening of said blocking member body and mates with the threads of the nut central opening allowing the nut to ride up the gas cylinder threads to secure said blocking member to said gas cylinder with said blocking member permitted to rotate in place around said gas cylinder; wherein when said nut is secured to the threaded end of said gas cylinder a portion of the cylinder threads extend our of said nut for mating with the internal threads of said internal passageway of said body to attach said the gas cylinder to said body;

wherein prior to detonation of an attached gas cylinder, said post member of said indicator contacts said protrusion of said blocking member such that said first color area of said indicator is viewable through the window of said body; wherein upon detonation of an attached gas cylinder said post member breaks said protrusion such that said second color area of said indicator is viewable through the window;

wherein to detonate a gas cylinder secured to said body, said handle is pulled or jerk causing the lanyard to move the contact arm to push said positioning assembly and said indicator forward which causes the post member to break the protrusion of said blocking member and the piercing end of said piercing assembly to break the seal at the threaded end of the secured gas cylinder causing gas to escape from the gas cylinder and enter into the internal passageway of said body for delivery into an internal passageway of a manifold that is secured to said body at said body opening.

11. The manual gas inflator of claim 10 wherein the opening at the back surface of said body is shaped such that a manifold to which the body is secured to can only be inserted one way into the opening to ensure that an opening in the manifold aligns with the internal passageway of said body when said body is secured to the manifold.

12. The manual gas inflator of claim 10 wherein said nut having a side passageway extending from an outer end of said nut to the central opening of said nut; wherein said inflator thither comprising a screw; wherein once said nut is properly secured and positioned with respect to the gas cylinder threads said screw is secured within said side passageway and contacts a portion of said gas cylinder threads to prevent said gas cylinder from substantially moving or rotating with respect to said nut.

13. The manual gas inflator of claim 12 wherein said screw is permanently secured within said side passageway.

14. The manual gas inflator of claim 10 wherein said indicator having a cutout and an internal passageway, said internal passageway of said indicator in communication with the cutout; wherein said positioning assembly having a first post member, wherein said manual gas inflator further comprising a spring disposed on the first post member of said positioning assembly and within the indicator cutout; wherein prior to detonation of the secured gas cylinder said first post member is positioned within the cutout and indicator passageway and the protrusion abutting the post member of said indicator prevents the indicator from moving forward and causing the spring to be in a compressed state; wherein upon detonation of the secured gas cylinder the breaking of the protrusion allows the spring to expand to maintain the position of said indicator with respect to the body such that the second color area to be viewable through the window of said body.

15. The manual gas inflator of claim 10 wherein said first color area is "green" in color and the second color area is "red" in color.

16. A manual gas inflator comprising:

a body having a front surface and a back surface, the front surface defining a window and having a body opening extending from said front surface to said back surface, said body having an internal passageway beginning at a top end and terminating at the body opening such that the internal passageway is in communication with the body opening, said internal passageway of said body having internal threads at least proximate to the top end of said body;

an activation assembly movably secured to said body, said activation assembly having a contact arm, a lanyard and a handle, said lanyard secured at a first end to said contact arm and at a second end to said handle;

an indicator internally disposed within said body, said indicator having a front surface, said indicator front surface having a first color area and a second color area, said second color area being different in color from said first color area, said indicator having a post member, said first color area indicating a full gas cylinder is properly attached to said body and said second color area indicating that a detonated or empty gas cylinder is attached to said body, said indicator having a cutout and an internal passageway, said internal passageway of said indicator in communication with the cutout;

a positioning assembly internally disposed within said body and physically contacting said indicator, said positioning assembly having a first post member, said contact arm positioned within said body proximate to said positioning assembly;

a spring disposed on the first post member of said positioning assembly and within the indicator cutout;

a piercing assembly having a piercing end, said piercing assembly secured to said indicator;

a blocking member having a body with an extended arm, said arm defining an internal area and having the protrusion extending within the internal area, said blocking member body defining a central opening; said blocking member adapted for attachment to the gas cylinder, the gas cylinder having a threaded end which is sealed prior to detonation;

a nut defining a central opening, said nut central opening at least partially threaded;

wherein to attach said blocking member to the gas cylinder the threaded end of the gas cylinder is inserted through the central opening of said blocking member body and mates with the threads of the nut central opening allowing the nut to ride up the gas cylinder threads to secure said blocking member to said gas cylinder with said blocking member permitted to rotate in place around said gas cylinder; wherein when said nut is secured to the threaded end of said gas cylinder a portion of the cylinder threads extend our of said nut for mating with the internal threads of said internal passageway of said body to attach said the gas cylinder to said body;

wherein prior to detonation of the attached gas cylinder, said post member of said indicator contacts said protrusion of said blocking member such that said first color area of said indicator is viewable through the window of said body; wherein upon detonation of an attached gas cylinder said post member breaks said protrusion such that said second color area of said indicator is viewable through the window;

wherein prior to detonation of the attached gas cylinder said first post member is positioned within the cutout and indicator passageway and the protrusion abutting the post member of said indicator prevents the indicator from moving forward and causing the spring to be in a compressed state; wherein upon detonation of the secured gas cylinder the breaking of the protrusion allows the spring to expand to maintain the position of said indicator with respect to the body such that the second color area to be viewable through the window of said body;

wherein to detonate the gas cylinder secured to said body, said handle is pulled or jerk causing the lanyard to move the contact arm to push said positioning assembly and said indicator forward which causes the post member to break the protrusion of said blocking member and the piercing end of said piercing assembly to break the seal at the threaded end of the secured gas cylinder causing gas to escape from the gas cylinder and enter into the internal passageway of said body for delivery into an internal passageway of a manifold that is secured to said body at said body opening.

17. The manual gas inflator of claim 16 wherein the opening at the back surface of said body is shaped such that a manifold to which the body is secured to can only be inserted one way into the opening to ensure that an opening in the manifold aligns with the internal passageway of said body when said body is secured to the manifold.

18. The manual gas inflator of claim 16 wherein said nut having a side passageway extending from an outer end of said nut to the central opening of said nut; wherein said inflator further comprising a screw; wherein once said nut is properly secured and positioned with respect to the gas cylinder threads said screw is secured within said side passageway and contacts a portion of said gas cylinder threads to prevent said gas cylinder from substantially moving or rotating with respect to said nut.

19. The manual gas inflator of claim 18 wherein said screw is permanently secured within said side passageway.

20. The manual gas inflator of claim 10 wherein said first color area is "green" in color and the second color area is "red" in color.

21. A rearming assembly for a gas inflator, comprising:

a gas cylinder having external threads at a sealed end and containing a gas;

a blocking member having a body with an extended arm, said arm defining an internal area and having a protrusion extending within the internal area, said blocking member body defining a central opening said blocking member adapted for attachment to the gas cylinder, the gas cylinder having a threaded end which is sealed prior to detonation;

a nut defining a central opening, said nut central opening at least partially threaded;

wherein to attach said blocking member to the gas cylinder the sealed end of the gas cylinder having external threads is inserted through the central opening of said blocking member body and mates with internal threads of the nut central opening allowing the nut to ride up the gas cylinder threads to secure said blocking member to said gas cylinder with said blocking member permitted to rotate in place around said gas cylinder; wherein when said nut is secured to the threaded end of said gas cylinder a portion of the cylinder threads extend out of said nut for mating with internal threads of an inflator.

22. The rearming assembly of claim 21 wherein said nut having a side passageway extending from an outer end of said nut to the central opening of said nut;

wherein said rearming assembly further comprising a screw; wherein once said nut is properly secured and positioned with respect to the gas cylinder threads said screw is secured within said side passageway and contacts a portion of said gas cylinder threads to prevent said gas cylinder from substantially moving or rotating with respect to said nut.

23. The manual gas inflator of claim 22 wherein said screw is permanently secured within said side passageway.

24. The rearming assembly of claim 21 wherein said gas is carbon dioxide.

* * * * *